US008881897B2

(12) United States Patent
Roila et al.

(10) Patent No.: US 8,881,897 B2
(45) Date of Patent: Nov. 11, 2014

(54) PACKET OF CIGARETTES WITH A RIGID PULL-UP FLAP

(75) Inventors: Patrizio Roila, San Mariano di Corciano (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 14/005,842

(22) PCT Filed: Mar. 22, 2012

(86) PCT No.: PCT/IB2012/051382

§ 371 (c)(1),
(2), (4) Date: Nov. 15, 2013

(87) PCT Pub. No.: WO2012/127446

PCT Pub. Date: Sep. 27, 2012

(65) Prior Publication Data

US 2014/0054185 A1 Feb. 27, 2014

(30) Foreign Application Priority Data

Mar. 22, 2011 (IT) ..... BO2011A0140

(51) Int. Cl.
*B65D 85/10* (2006.01)
*A24F 15/04* (2006.01)

(52) U.S. Cl.
CPC ..... *A24F 15/04* (2013.01); *B65D 85/1009* (2013.01)
USPC ..... 206/254

(58) Field of Classification Search
CPC ..... B65D 85/1009; B65D 5/38; B65D 5/72; B65D 5/724; A24F 23/02
USPC ..... 206/254, 242, 249, 255
See application file for complete search history.

(56) References Cited

U.S. PATENT DOCUMENTS

| | | | | | |
|---|---|---|---|---|---|
| 2,258,170 | A | * | 10/1941 | Austin et al. | 221/259 |
| 2,415,117 | A | * | 2/1947 | Tamarin | 221/32 |
| 2,803,376 | A | * | 8/1957 | Kampff | 221/88 |
| 2,812,057 | A | * | 11/1957 | Brownfield | 206/250 |
| 3,108,711 | A | * | 10/1963 | Anton | 221/92 |
| 3,260,405 | A | * | 7/1966 | Frischer et al. | 221/32 |
| 3,878,968 | A | * | 4/1975 | Grinan | 221/274 |
| 4,709,811 | A | * | 12/1987 | Shimada | 206/254 |
| 4,778,962 | A | * | 10/1988 | Shimada | 206/254 |
| 4,949,841 | A | * | 8/1990 | Focke et al. | 206/254 |
| 7,147,103 | B2 | * | 12/2006 | Retelski | 206/250 |
| 2011/0017762 | A1 | * | 1/2011 | Emmett et al. | 221/1 |

* cited by examiner

*Primary Examiner* — Jacob K Ackun
(74) *Attorney, Agent, or Firm* — Marshall, Gerstein & Borun LLP

(57) ABSTRACT

A packet (1) of cigarettes having a group (4) of cigarettes; an inner package (3), which encloses the group (4) of cigarettes and has an extraction opening (5); and a pull-up flap (21), which is fitted to at least two cigarettes (22) in the group (4) of cigarettes, and has a grip end (23) which projects at the extraction opening (5) of the inner package (3) and is pulled up to lift up the cigarettes (22) to which the pull-up flap is fitted. The pull-up flap (21) is defined by a rigid blank (29) having at least one fold line (30) and folded into an L or a U about the bottom end (24) of part of the group (4) of cigarettes, and is completely detached from, and so slides freely with respect to, the inner package (3).

10 Claims, 11 Drawing Sheets

PACKET OF CIGARETTES WITH A RIGID PULL-UP FLAP

CROSS-REFERENCE TO RELATED APPLICATIONS

This is the U.S. national phase of International Application No. PCT/IB2012/051382, filed Mar. 22,2012, which claims the benefit of Italian Patent Application No. BO2011A000140, filed Mar. 22, 2011.

TECHNICAL FIELD

The present invention relates to a packet of cigarettes with a pull-up flap for extracting some of the cigarettes from the packet.

In the following description, reference is made, for the sake of simplicity and purely by way of a non-limiting example, to a rigid, hinged-lid packet of cigarettes.

BACKGROUND ART

A rigid, hinged-lid packet of cigarettes normally comprises an inner package containing a group of cigarettes; and a rigid outer container housing the inner package. The inner package is initially closed, and has a pull-off top portion, which is removed when the packet is unsealed, to enable removal of the cigarettes from the inner package.

The inner package and outer container often exert lateral compression on the group of cigarettes inside the inner package. And, when the packet is full, this lateral compression may make it difficult to extract the first cigarette from the group, due to friction between the first and surrounding cigarettes. One solution proposed to extract the first cigarette more easily is to fit at least one cigarette in the group with a pull-up strip, one end of which projects from the top wall of the group, and is gripped to pull the cigarette up.

The inner end, opposite the grip end, of known pull-up strips, however, must be glued to a wall of the inner package, which poses a serious drawback: the inner packages of packets of cigarettes are never glued, on account of glue on or close to the cigarettes releasing volatile substances, which are absorbed by the cigarettes and alter the aroma and/or taste of the tobacco.

Patent application WO9849072A1 discloses a method of packaging and package for a bundle of cigarettes; a flow seal package includes a resealable cigarette access which may be opened to permit withdrawal of the cigarette and then a suitable tab resealed on the barrier material to reseal the access opening.

DESCRIPTION OF THE INVENTION

It is an object of the present invention to provide a packet of cigarettes with a pull-up flap, designed to eliminate the above drawbacks, and which is cheap and easy to produce.

According to the present invention, there is provided a packet of cigarettes with a pull-up flap, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 3:
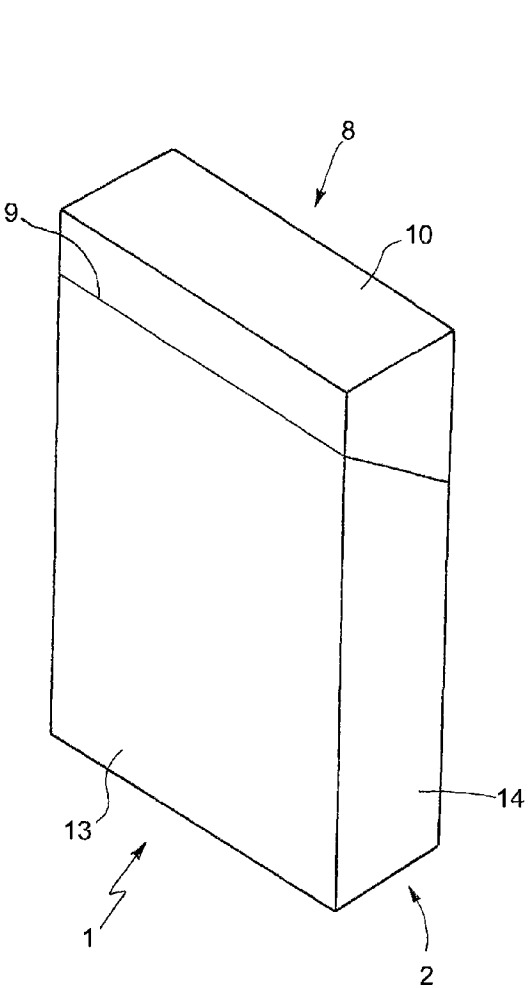
FIG. 3 shows a rear view in perspective of the FIG. 1 packet of cigarettes in the closed configuration.
Figure 2:
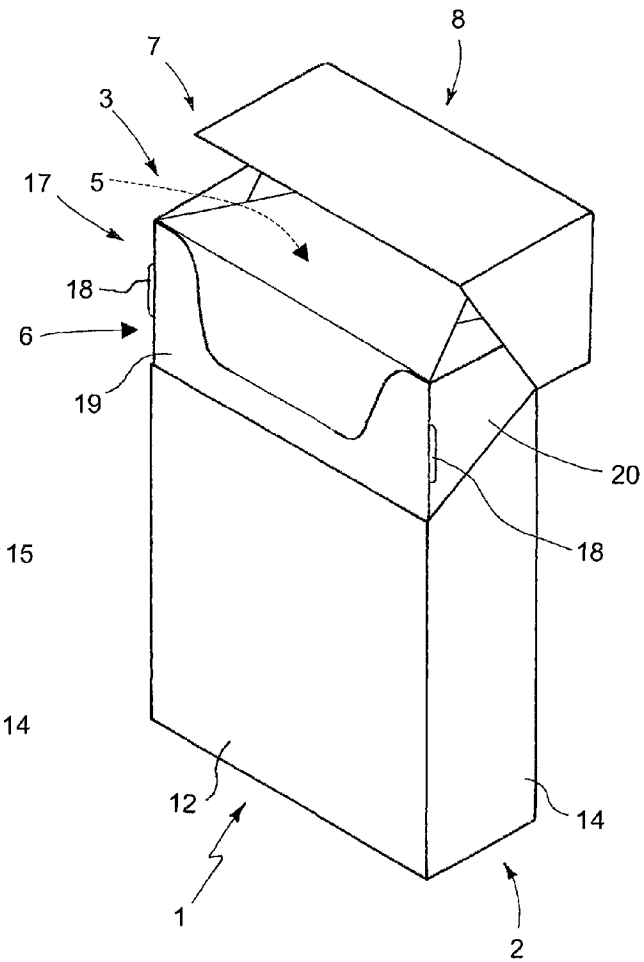
FIG. 2 shows a front view in perspective of the FIG. 1 packet of cigarettes in an open configuration.
Figure 1:
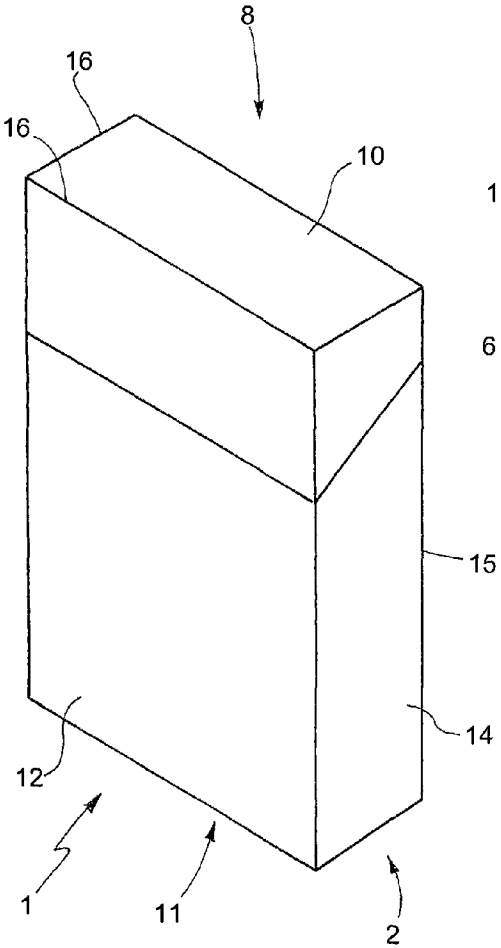
FIG. 1 shows a front view in perspective of a packet of cigarettes with a rigid pull-up flap, in accordance with the present invention and in a closed configuration.

Number 1 in FIGS. 1, 2 and 3 indicates as a whole a rigid packet of cigarettes comprising a cup-shaped outer container 2 of rigid cardboard; and an inner package 3 housed irremovably inside outer container 2 (i.e. inner package 3 is normally glued, so as to in no way move with respect to outer container 2). Inner package 3 contains a parallelepiped-shaped group 4 of cigarettes (FIGS. 4-7), and at the top and front has a cigarette extraction opening 5 closed by a pull-off cover portion 6 and extending over part of a front wall and part of a top wall of inner package 3 (i.e. extraction opening 5 is at least initially closed by cover portion 6). When packet 1 of cigarettes is unsealed, pull-off cover portion 6 is removed to enable withdrawal of the cigarettes from inner package 3, i.e. when packet 1 of cigarettes in unsealed, inner package 3 goes from the FIG. 2 configuration (pull-off cover portion 6 intact) to the FIG. 4 configuration (pull-off cover portion 6 removed).

In a different embodiment not shown, inner package is sealed, and pull-off cover portion 6 initially closing extraction opening 5 is replaced with an open-close sealing flap movable between a closed position closing extraction opening 5, and an open position opening extraction opening 5.

Outer container 2 has an open top end 7; and a cup-shaped lid 8 hinged to outer container 2 along a hinge 9 to rotate, with respect to outer container 2, between an open position (FIG. 2) and a closed position (FIGS. 1 and 3) opening and closing open top end 7 respectively.

When lid 8 is in the closed position, outer container 2 is in the form of a rectangular parallelepiped having a top wall 10 and an opposite, parallel bottom wall 11; two opposite, parallel major lateral walls 12 and 13; and two opposite, parallel minor lateral walls 14. More specifically, one major lateral wall 12 defines a front wall 12 of outer container 2, and the other major lateral wall 13 defines a rear wall 13 of outer container 2; four longitudinal edges 15 are defined between minor lateral walls 14 and front and rear walls 12, 13; and eight transverse edges 16 are defined between top and bottom walls 10, 11 and front, rear, and minor lateral walls 12, 13, 14.

In the FIGS. 1-3 embodiment, edges 15 and 16 are all square. In alternative embodiments not shown, edges 15 and 16 may be bevelled or rounded.

Packet 1 also comprises a rigid collar 17 (i.e. made of rigid cardboard), which is folded into a U and fixed (glued) to the inside of outer container 2, and projects partly from open top end 7 to engage a corresponding inner surface of lid 8 when this is closed. In a preferred embodiment, collar 17 has two projections 18, which project laterally to interferentially engage the lateral walls of lid 8 to hold lid 8 in the closed position. Collar 17 comprises a front wall 19 positioned contacting front wall 12 of outer container 2; and two lateral walls 20 located on opposite sides of front wall 19 and positioned substantially contacting minor lateral walls 14 of outer container 2.

As shown in FIGS. 4-8, a rigid pull-up flap 21 is inserted inside inner package 3, directly contacting cigarettes 22 in group 4, engages a front row of cigarettes 22 in group 4, and has a grip end 23 located in front of group 4 of cigarettes at extraction opening 5 of inner package 3, and which is pulled up to raise the front row of cigarettes 22. As shown more clearly in FIGS. 7 and 8, pull-up flap 21 is folded into a U about a bottom end 24 of the front row of cigarettes 22 inside inner package 3. Pull-up flap 21 is completely detached from, i.e. is in no way connected mechanically to, inner package 3, which means the whole of pull-up flap 21 can slide (translate) freely with respect to inner package 3.

Figure 7:
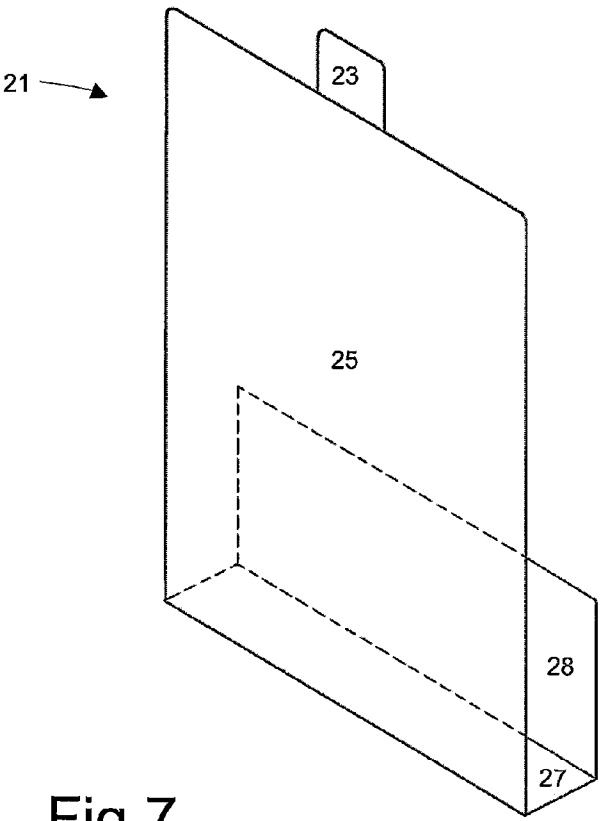
FIG. 7 shows a view in perspective of the rigid pull-up flap of the FIGS. 4-6 inner package.
Figure 8:
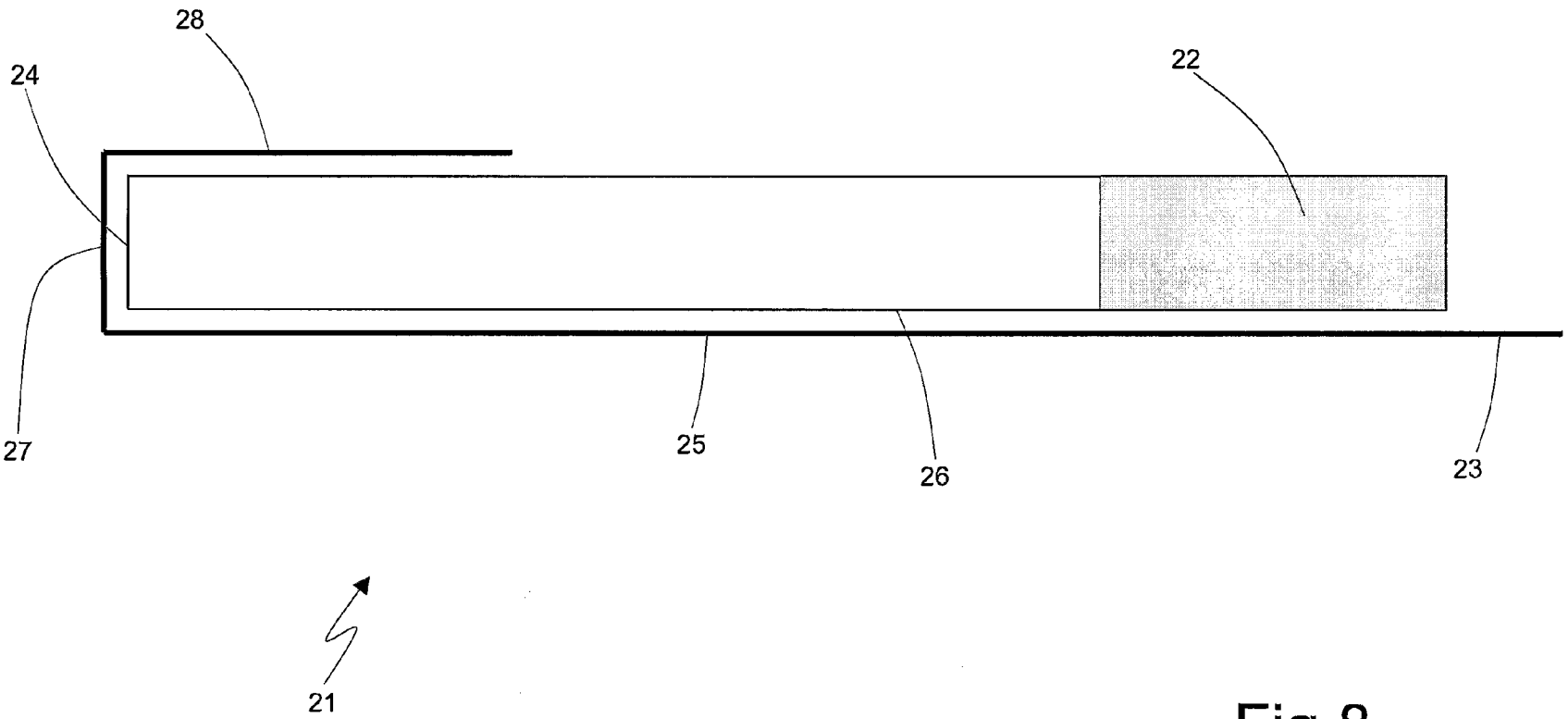
FIG. 8 shows a schematic side view of the rigid pull-up flap of the FIGS. 4-6 inner package, as fitted to the front row of cigarettes in the group.

As shown more clearly in FIGS. 7 and 8, pull-up flap 21 comprises a vertical front wall 25 terminating with grip end 23 and positioned contacting a cylindrical lateral wall 26 of the front row of cigarettes 22; a horizontal bottom wall 27 perpendicular to vertical front wall 25 and positioned contacting the bottom end 24 of the front row of cigarettes 22; and a vertical rear wall 28 parallel to vertical front wall 25 and positioned contacting cylindrical lateral wall 26 of the front row of cigarettes 22, on the opposite side to vertical front wall 25. Vertical rear wall 28 of pull-up flap 21 is shorter in height than, and roughly ⅓-⅕ the height of, vertical front wall 25.

Figure 5:
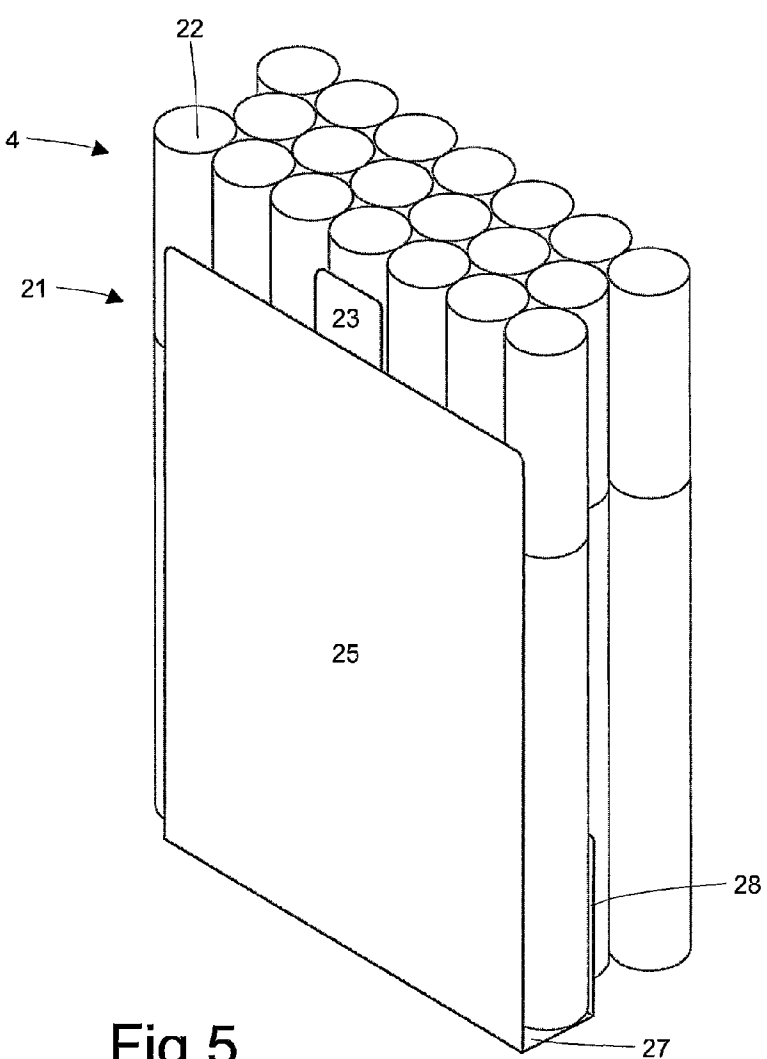
FIG. 5 shows a front view in perspective of a group of cigarettes enclosed in the FIG. 4 inner package and fitted with the rigid pull-up flap.
Figure 4:
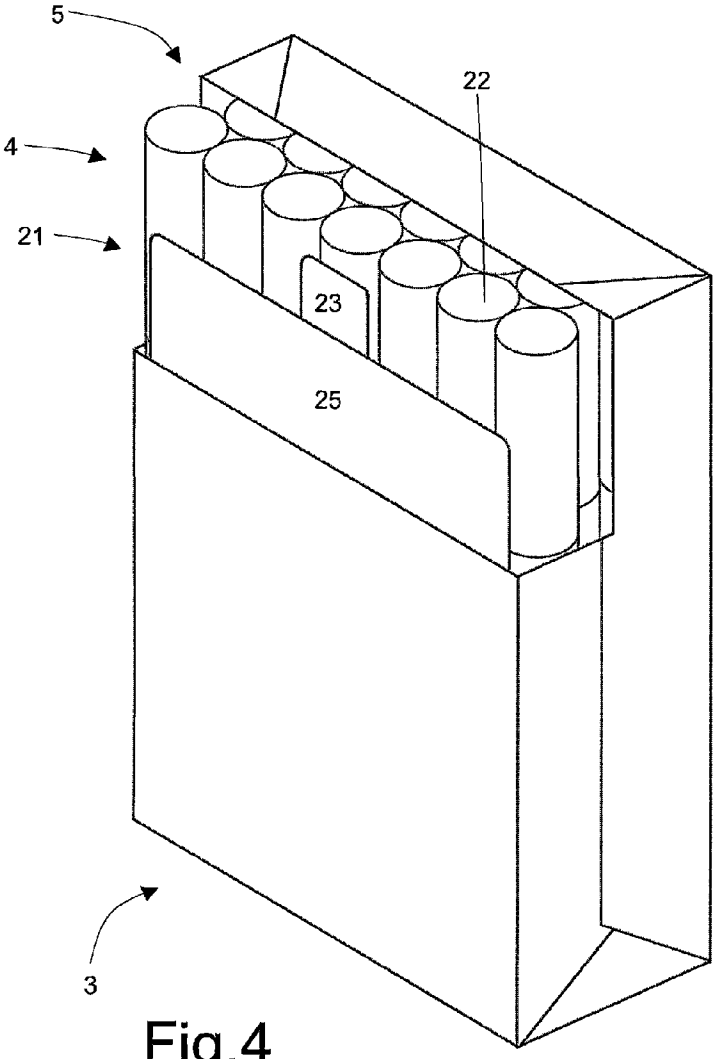
FIG. 4 shows a front view in perspective of an inner package of the FIG. 1 packet of cigarettes, with a pull-off top portion removed.
Figure 6:
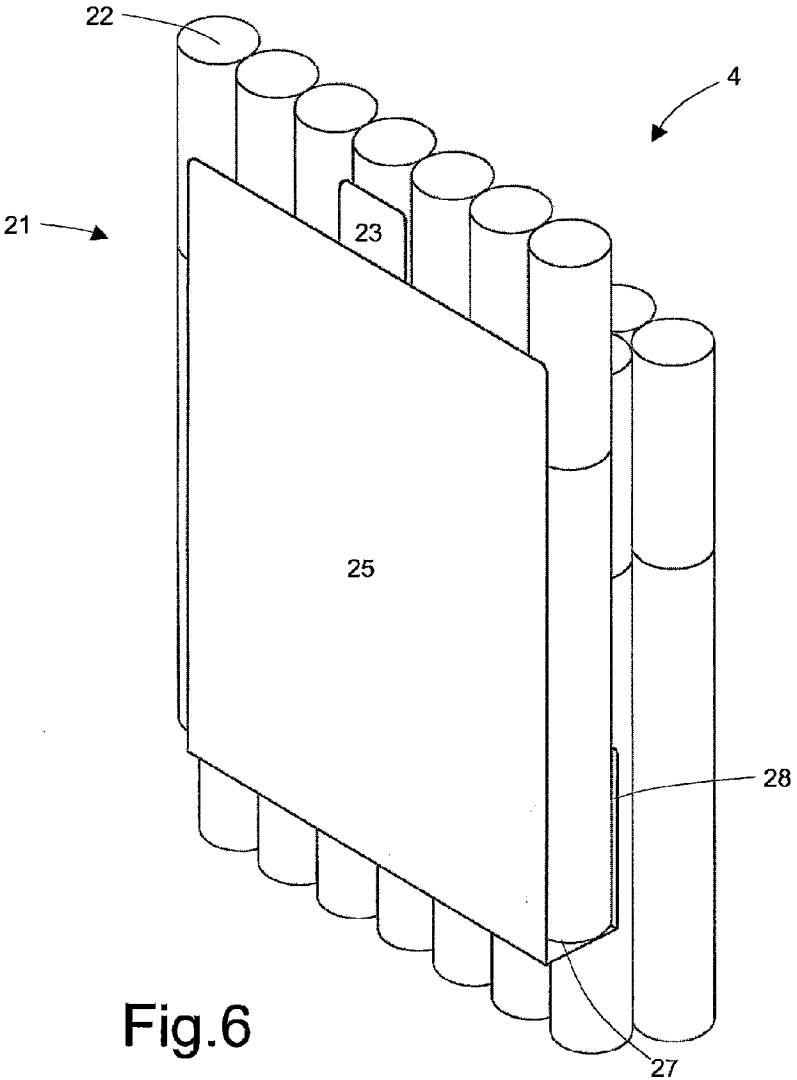
FIG. 6 shows a front view in perspective of the FIG. 5 group of cigarettes when extracting the first cigarette.

When packet 1 of cigarettes is sealed and therefore inner package 3 unopened, extraction opening 5 of inner package 3 is closed by pull-off cover portion 6, which presses grip end 23 of pull-up flap 21 against the front wall of group 4 of cigarettes. When packet 1 of cigarettes in unsealed and cover portion 6 removed, grip end 23 of pull-up flap 21 springs back slightly off the front wall of group 4 of cigarettes for easy grip by the user (as shown in FIGS. 4 and 5). Holding grip end 23, the user pulls pull-up flap 21 vertically upwards together with the front row of cigarettes 22 (as shown in FIG. 6), which is raised with respect to the rest of group 4 (FIG. 6) for easy removal of one of cigarettes 22 from the front row. After removing one (or more) of cigarettes 22 from packet 1, the user simply presses the front row of cigarettes 22 (raised using grip end 23 of pull-up flap 21) back down, and closes lid 8 pending further use of packet 1.

It is important to note that, pull-up flap 21 being as wide as the whole front row of cigarettes 22 in group 4, the lateral edges of pull-up flap 21 are positioned contacting the lateral walls of inner package 3, which thus act as 'guides' to prevent pull-up flap 21 from rotating with respect to packet 1 (i.e. with respect to outer container 2, inner package 3, and group 4) and so tilting laterally as it slides up or down (thus seriously compressing and permanently damaging cigarettes 22).

When the user pulls up grip end 23 of pull-up flap 21 to extract the front row of cigarettes 22, the U shape of pull-up flap 21 prevents it from sliding with respect to, as opposed to raising, the front row of cigarettes 22 (i.e. prevents the pull-up flap 21 from sliding empty out of group 4, without raising the front row of cigarettes). That is, if pull-up flap 21 were to slide with respect to the front row of cigarettes 22 (i.e. to slide out of group 4) when the user pulls on grip end 23, the vertical rear wall 28 of pull-up flap 21 would have to deform to slide under group 4. But, because of the size and stiffness of vertical rear wall 28, deforming it would require more force than that needed to lift pull-up flap 21 together with the front row of cigarettes 22. Any initial slide of pull-up flap 21 with respect to the front row of cigarettes 22 is therefore counteracted as soon as vertical rear wall 28 reaches the point at which it has to deform to slide under group 4, and because of the greater force required for it to do so.

Figure 9:
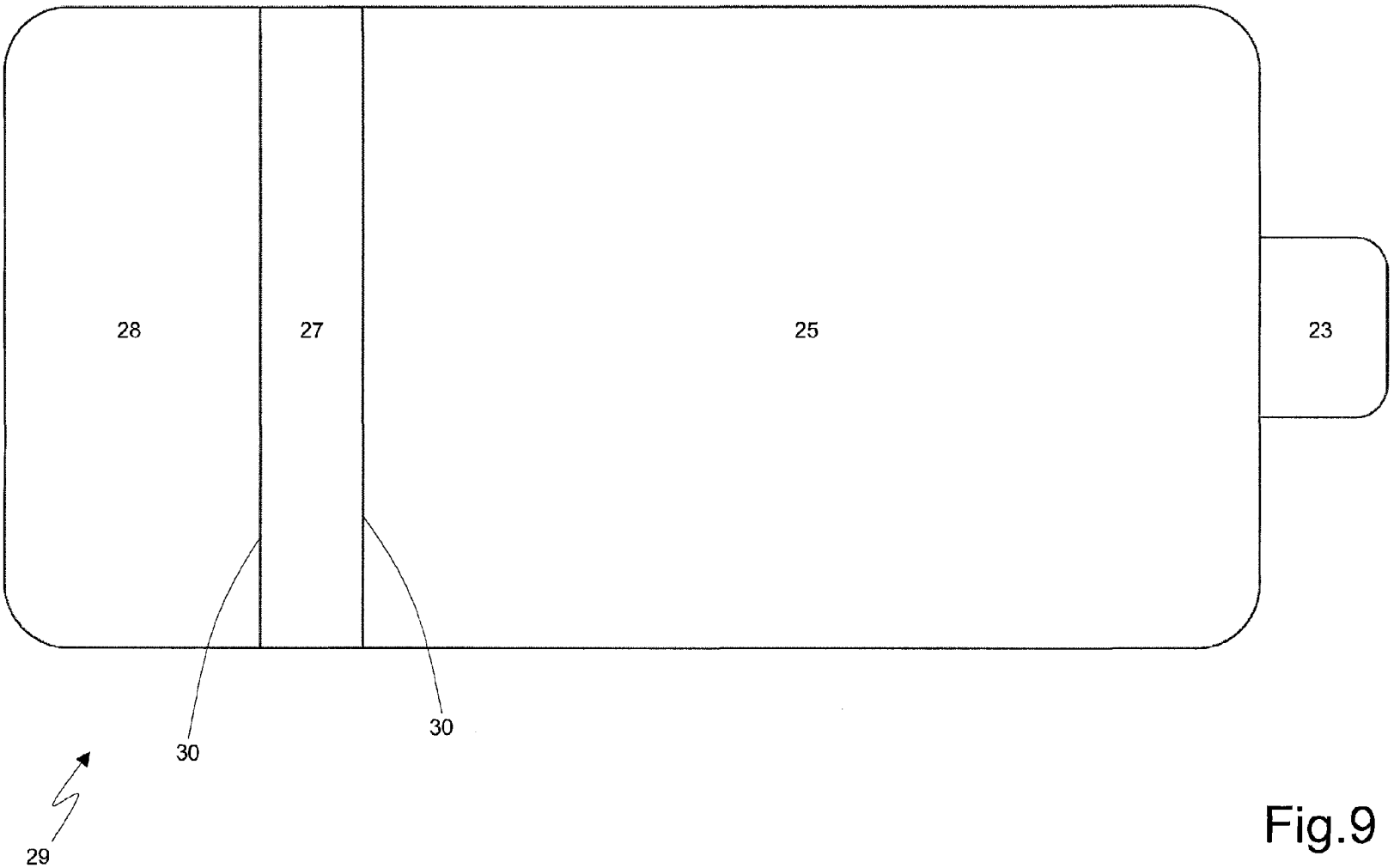
FIG. 9 shows a spread-out view of a blank from which to form the rigid pull-up flap of the FIGS. 4-6 inner package.
Figure 11:
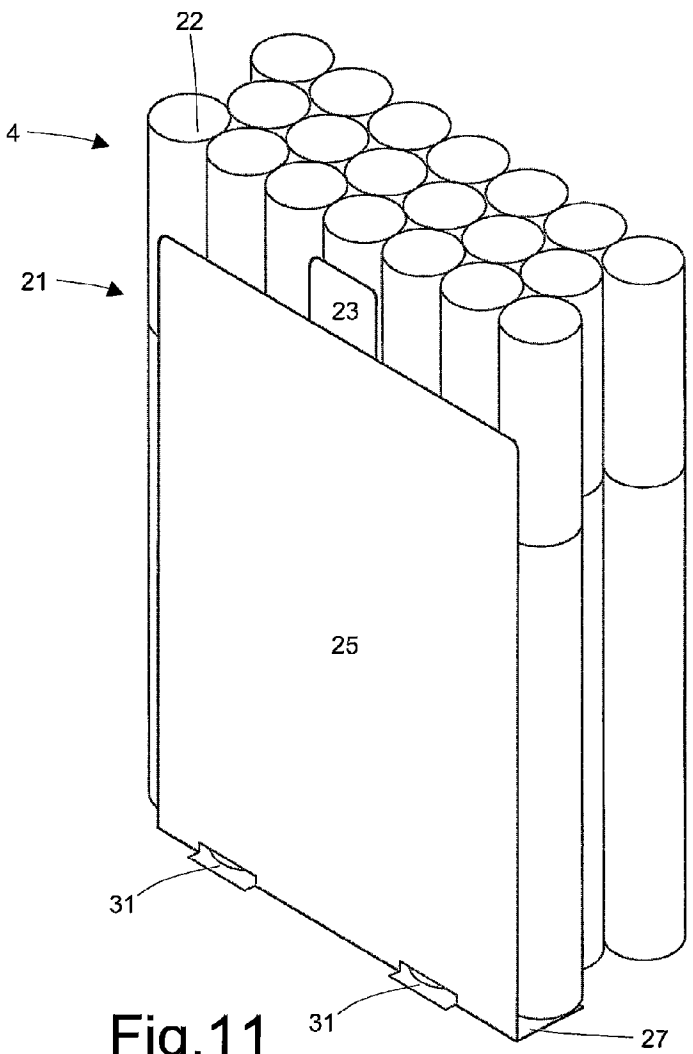
FIG. 11 shows a front view in perspective of a group of cigarettes enclosed in the FIG. 10 inner package and fitted with the rigid pull-up flap.
Figure 10:
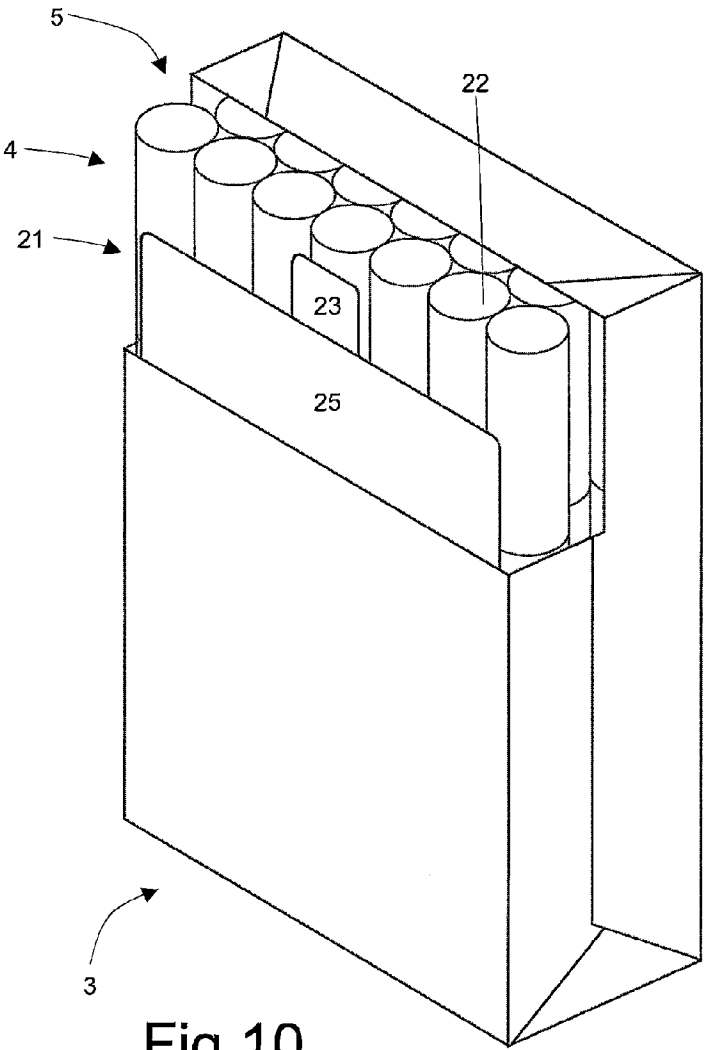
FIG. 10 shows a front view in perspective of an inner package of the FIG. 1 packet of cigarettes, with a pull-off top portion removed and a different embodiment of the rigid pull-up flap.
Figure 13:
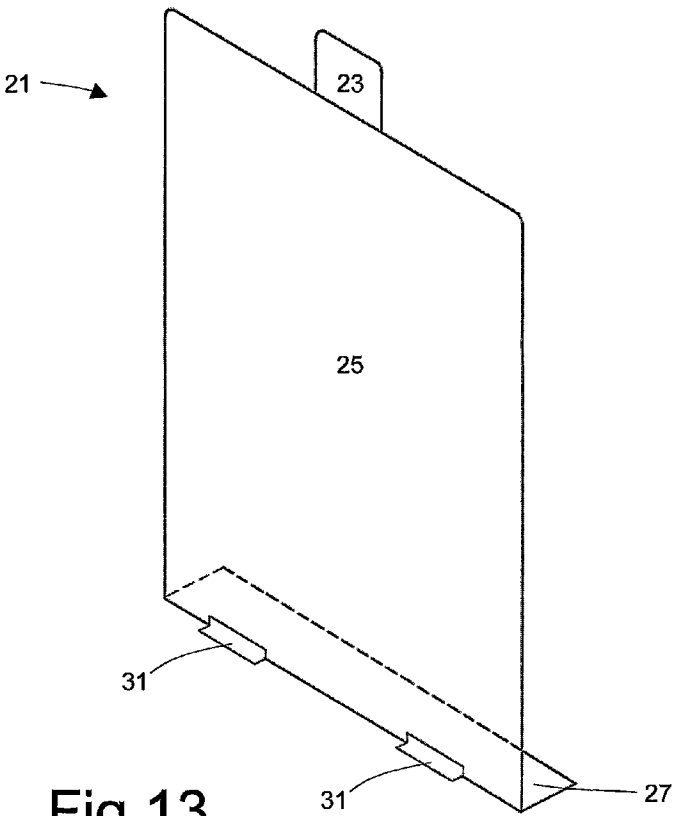
FIG. 13 shows a view in perspective of the rigid pull-up flap of the FIGS. 10-12 inner package.
Figure 12:
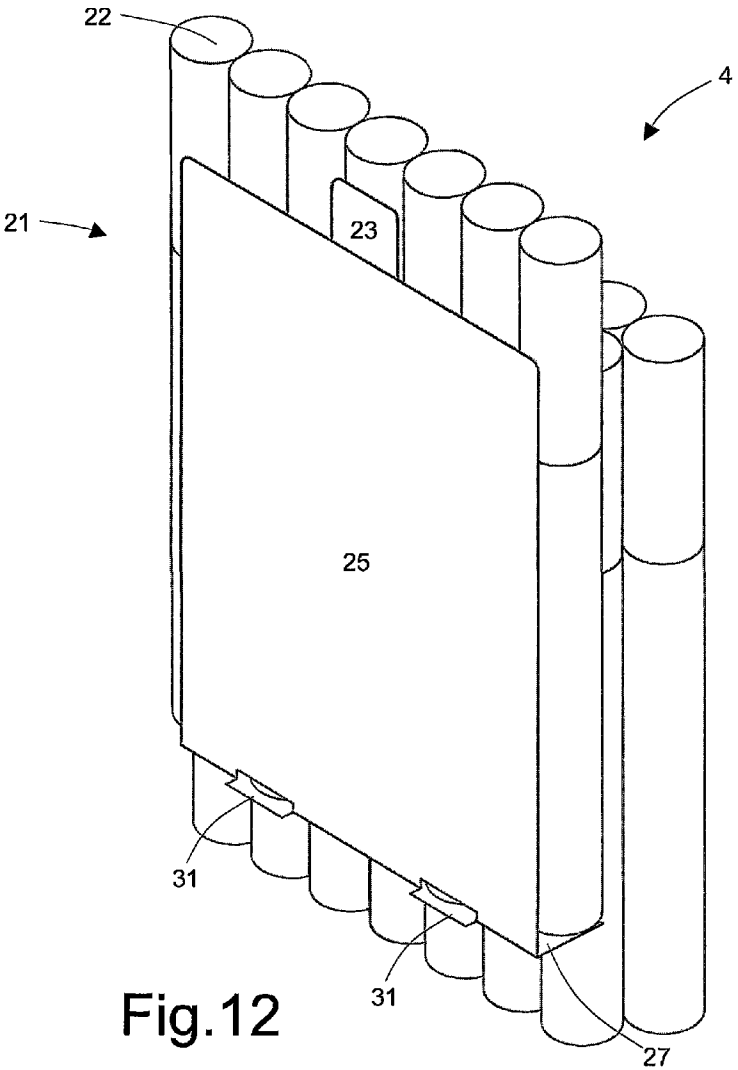
FIG. 12 shows a front view in perspective of the FIG. 11 group of cigarettes when extracting the first cigarette.

As shown in FIG. 9, pull-up flap 21 is formed by folding inside group 4 of cigarettes a blank 29 made of rigid material (typically cardboard) and having two preformed fold lines 30 separating front wall 25 from bottom wall 27, and bottom wall 27 from rear wall 28.

FIGS. 10-14 show a different embodiment of rigid pull-up flap 21, in which rear wall 28 is eliminated, and its function (described above) of preventing pull-up flap 21 from sliding with respect to the front row of cigarettes 22 is performed by two stabilizing projections 31 projecting from front wall 25 and forming a natural extension of bottom wall 27. In other words, stabilizing projections 31 project perpendicular to front wall 25, and push (with a small amount of local deformation) against the front wall of inner package 3, and therefore the front wall 12 of outer container 2, to increase the force needed to slide pull-up flap 21, and so prevent pull-up flap 21 from sliding, with respect to the front row of cigarettes 22. In other words, stabilizing projections 31 make the force required to slide pull-up flap 21 with respect to the front row of cigarettes 22 so much greater than the force required to raise pull-up flap 21 together with the front row of cigarettes 22 that pull-up flap 21 is always raised together with the front row of cigarettes 22 when grip end 23 of pull-up flap 21 is pulled up.

To optimize performance, the number, size and shape of stabilizing projections 31 in the FIGS. 10-14 embodiment may vary, depending on the design of packet 1 of cigarettes.

Figure 14:
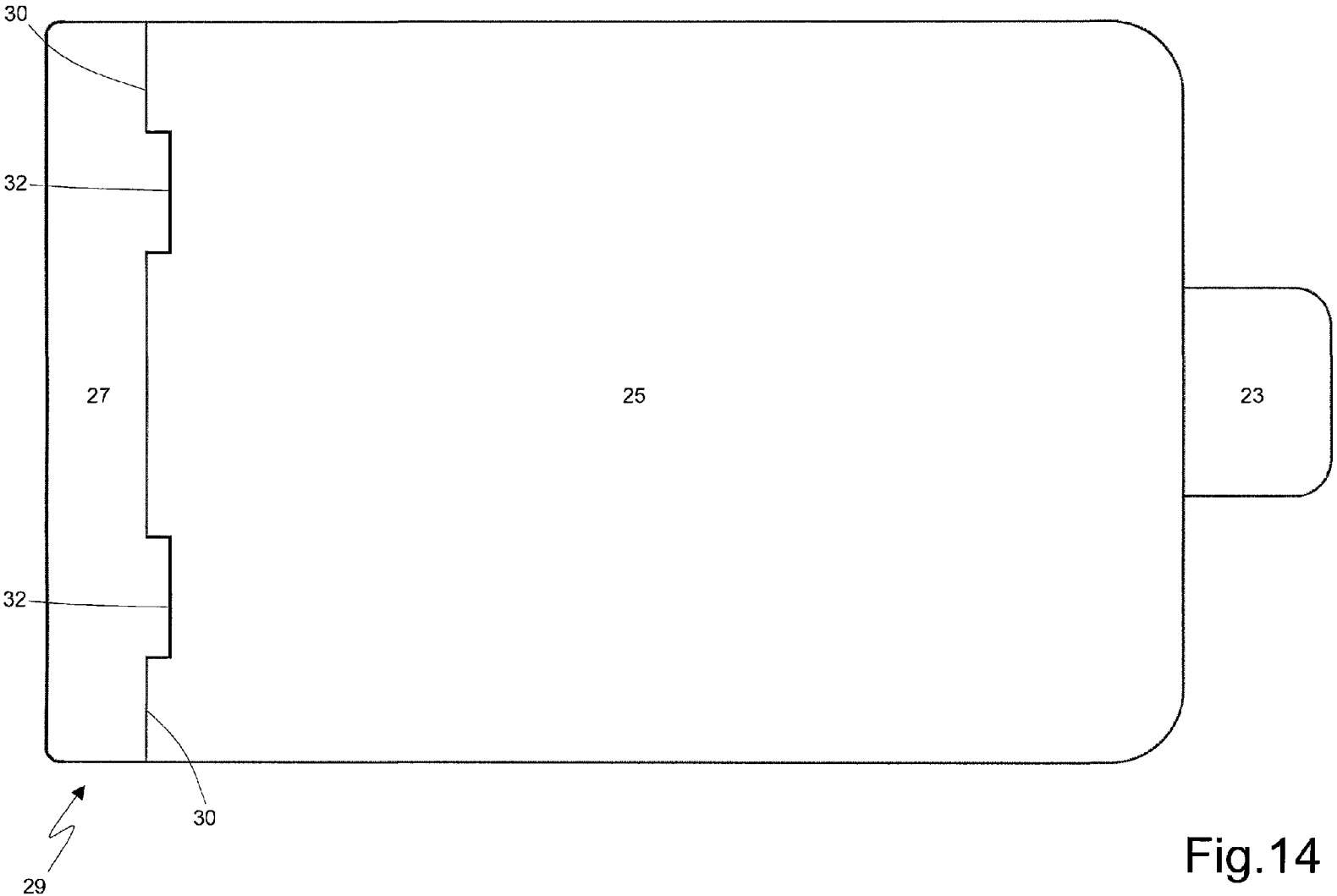
FIG. 14 shows a spread-out view of a blank from which to form the rigid pull-up flap of the FIGS. 10-12 inner package.
Figure 16:
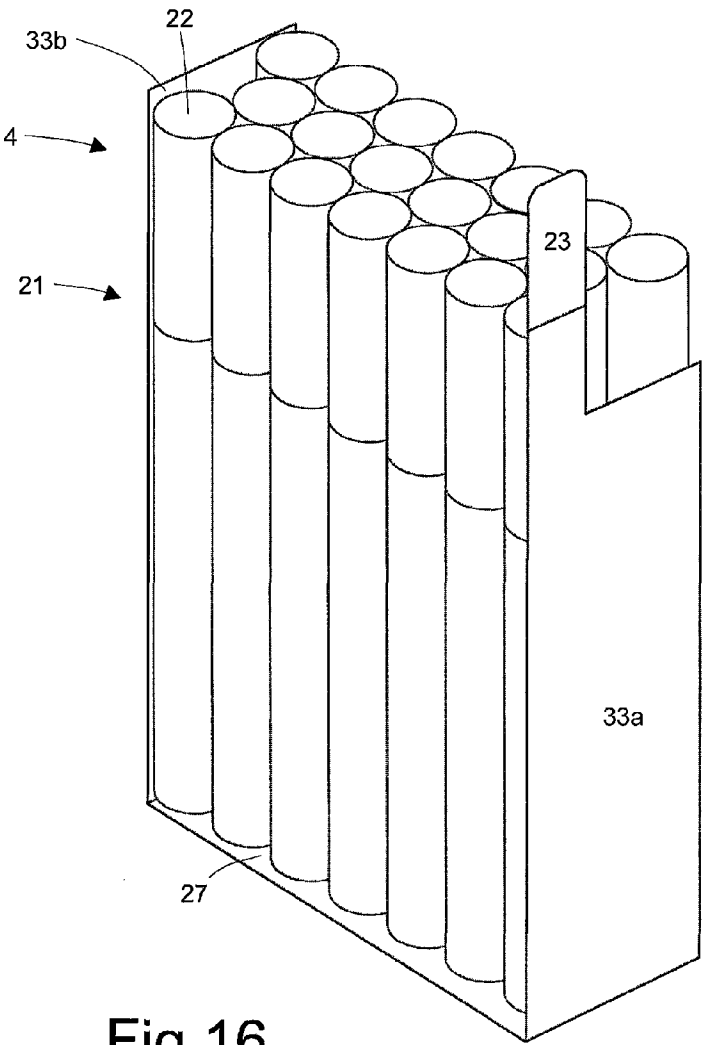
FIG. 16 shows a front view in perspective of a group of cigarettes enclosed in the FIG. 15 inner package and fitted with the rigid pull-up flap.
Figure 15:
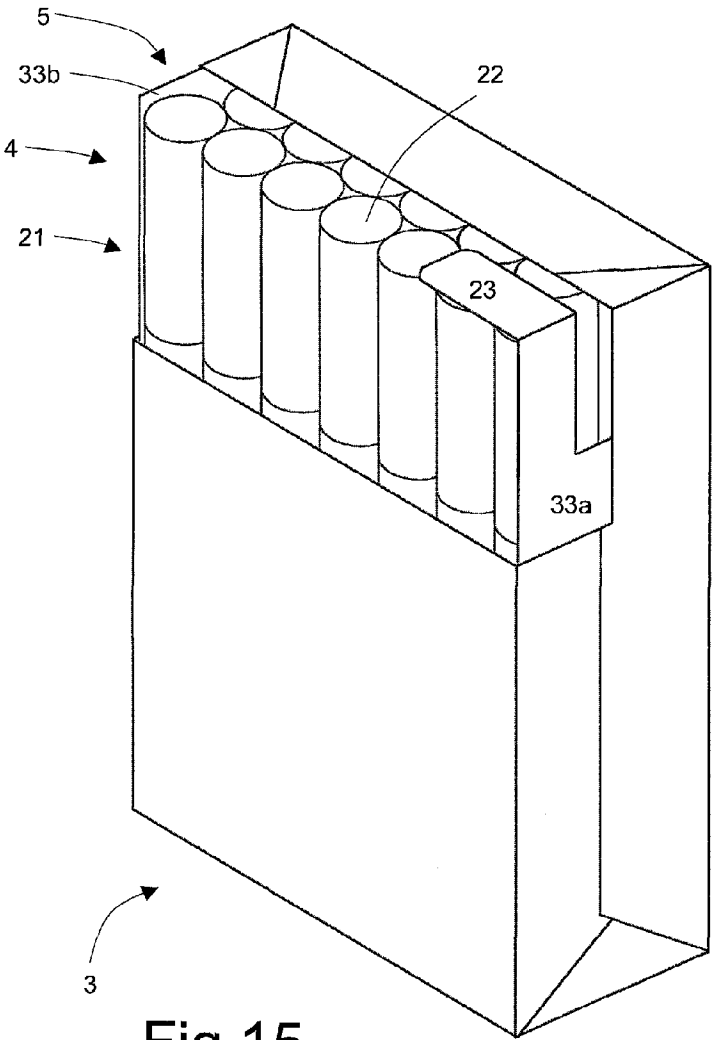
FIG. 15 shows a front view in perspective of an inner package of the FIG. 1 packet of cigarettes, with a pull-off top portion removed and a further embodiment of the rigid pull-up flap.
Figure 18:
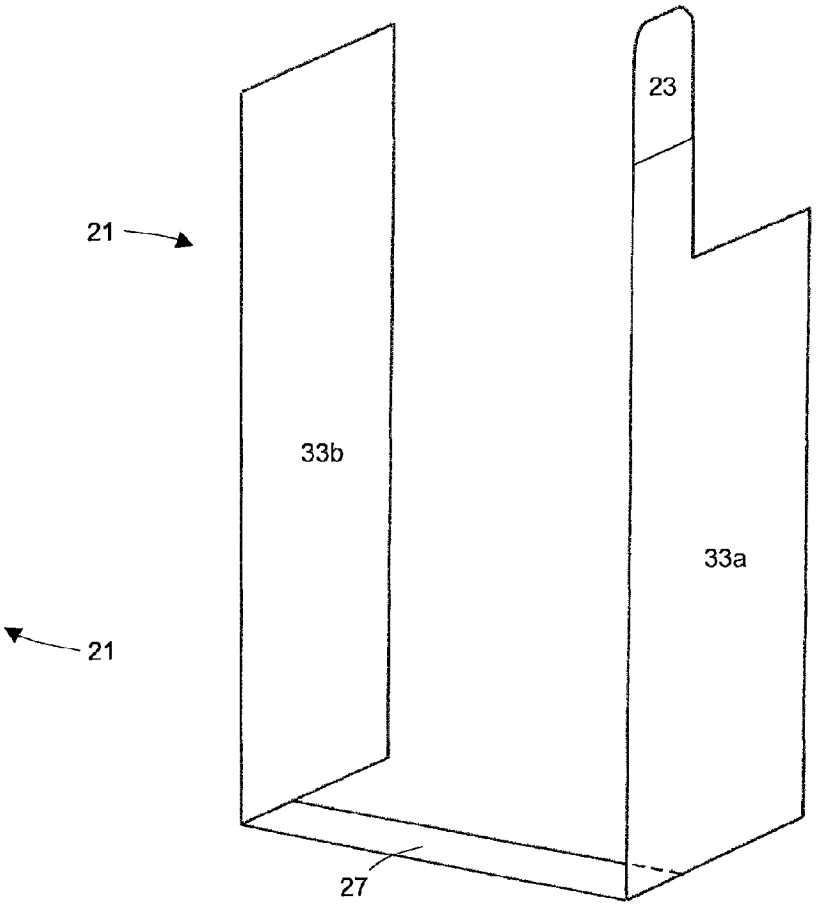
FIG. 18 shows a view in perspective of the rigid pull-up flap of the FIGS. 15-17 inner package.
Figure 17:
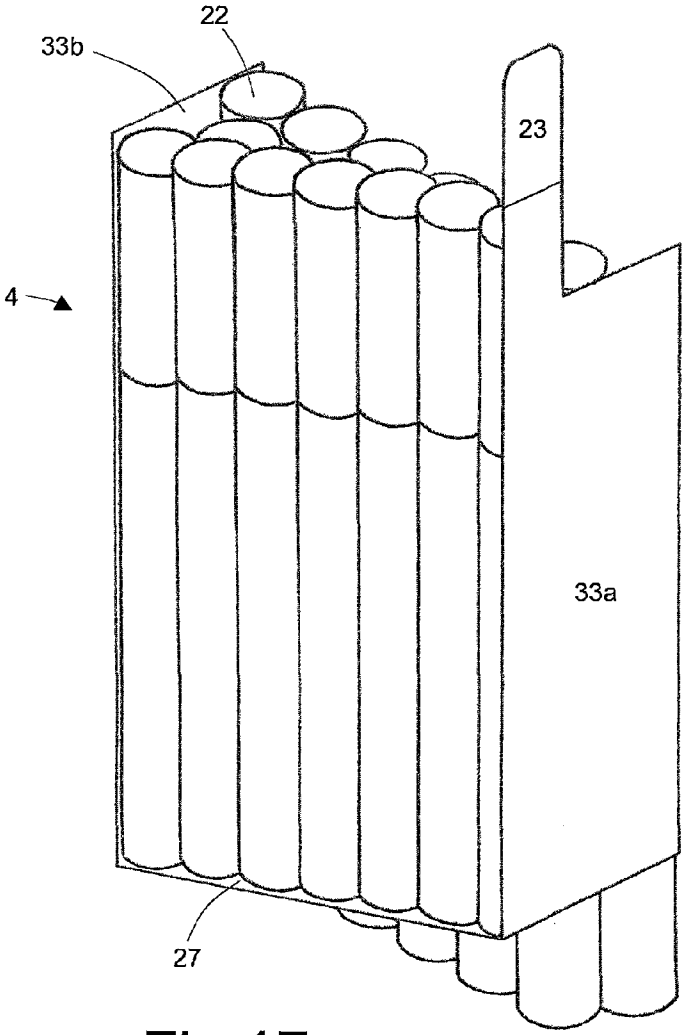
FIG. 17 shows a front view in perspective of the FIG. 16 group of cigarettes when extracting the first cigarette.
Figure 19:
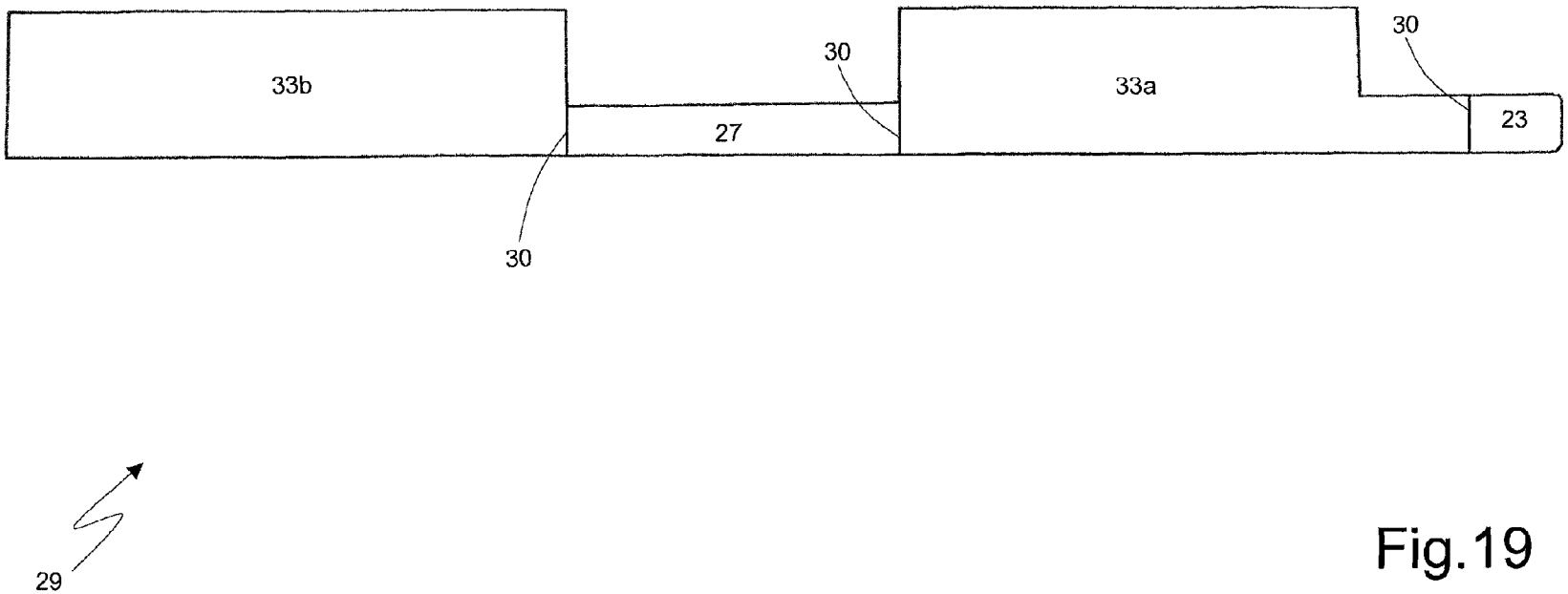
FIG. 19 shows a spread-out view of a blank from which to form the rigid pull-up flap of the FIGS. 15-17 inner package.

As shown in FIG. 14, each stabilizing projection 31 is formed in blank 29 by a U-shaped through cut 32, which defines the outer edge of stabilizing projection 31 and originates at fold line 30, which does not extend across cut 32. In other words, the two ends of each through cut 32 originate at fold line 30, which is interrupted at (i.e. does not extend across) through cut 32.

FIGS. 15-19 show a further embodiment of rigid pull-up flap 21, in which pull-up flap 21 is folded into a U about the bottom end 24 of the front row of cigarettes in inner package 3. As shown more clearly in FIG. 18, pull-up flap 21 comprises two vertical lateral walls 33 located on opposite sides of the front row of cigarettes 22, and each contacting a respective cylindrical lateral wall 26 of the front row of cigarettes 22. One lateral wall 33*a* of pull-up flap 21 terminates with grip end 23 projecting from the top wall of group 4 of cigarettes; the other lateral wall 33*b* has no grip end 23, and is the same height as group 4 of cigarettes; and the two lateral walls 33 of pull-up flap are joined by horizontal bottom wall 27, which is perpendicular to lateral walls 33 and positioned contacting bottom wall 24 of the front row of cigarettes 22.

In actual use, when grip end 23 of pull-up flap 21 is pulled up, the lateral wall 33*a* connected directly to grip end 23 is raised vertically with it, while the other lateral wall 33*b* remains substantially unmoved. Bottom wall 27 thus tilts—by being raised at one end and remaining substantially stationary at the other—to raise the front row of cigarettes 22 differentially (gradually higher towards grip end 23, and lower away from grip end 23) as shown clearly in FIG. 17.

In all the embodiments shown in the drawings, bottom wall 27 of pull-up flap 21 is the same size as bottom end 24 of the front row of cigarettes 22, and so raises the whole of and only the front row of cigarettes when grip end 23 is pulled up. In an alternative embodiment not shown, bottom wall 27 of pull-up flap 21 is larger than bottom end 24 of the front row of cigarettes 22, and so, when grip end 23 is pulled up, raises other cigarettes, in addition to those in the front row (e.g. raises the whole front row and the whole intermediate row of cigarettes 22, or the whole front row and part of the intermediate row of cigarettes 22). In another embodiment not shown, bottom wall 27 of pull-up flap 21 is smaller than bottom wall 24 of the front row of cigarettes 22, and so, when grip end 23 is pulled up, only raises part of the front row (e.g. the five middle cigarettes 22 in the front row; or the three middle cigarettes 22 in the front row, and the three middle cigarettes 22 in the intermediate row; or the two middle cigarettes 22 in the front row, the two middle cigarettes 22 in the intermediate row, and the two middle cigarettes in the rear row of cigarettes 22).

Packet 1 of cigarettes described has numerous advantages.

In particular, it comprises a pull-up flap 21 with a grip end 23 projecting from extraction opening 5 of inner package 3, and which is pulled by the user, when packet 1 is unsealed, to raise the front row of cigarettes 22 quickly and easily.

Having no glue, pull-up flap 21 can be applied on standard packing machines, and involves no risk of contaminating the cigarette tobacco.

Finally, packet 1 of cigarettes described can easily be produced on a standard packing machine (with only a few minor alterations), as opposed to a high-cost dedicated machine (specially designed for packets of this type).

The invention claimed is:

1. A packet (1) of cigarettes comprising:

a cup-shaped outer container (2);

a group (4) of cigarettes;

an inner package (3), which is inserted irremovably inside the outer container (2), encloses the group (4) of cigarettes, and has an extraction opening (5) closed at least initially by a cover portion (6); and a pull-up flap (21), which is inserted inside the inner package (3), directly contacting the cigarettes (22) in the group (4) of cigarettes, is fitted to at least two cigarettes (22) in the group (4) of cigarettes, and has a grip end (23) which projects at the extraction opening (5) of the inner package (3) and is pulled up to lift up the cigarettes (22) to which the pull-up flap is fitted;

wherein the pull-up flap (21) is defined by a rigid blank (29) having at least one fold line (30), and is completely detached from, and so slides freely with respect to, the inner package (3);

wherein the pull-up flap (21) is folded into an L about the bottom end (24) of the front row of cigarettes (22), and comprises a front wall (25) terminating with the grip end (23) and positioned contacting a cylindrical lateral wall (26) of the front row of cigarettes (22), and a bottom wall (27) perpendicular to the front wall (25) and positioned contacting the bottom end (24) of the front row of cigarettes (22); and wherein the pull-up flap (21) comprises at least one stabilizing projection (31) projecting from the front wall (25) on the opposite side of the cigarettes (22), defining a natural extension of the bottom wall (27), and pushing against a front wall of the inner package (3).

2. A packet (1) of cigarettes as claimed in claim 1, wherein the pull-up flap (21) is the same width as the whole front row of cigarettes (22) in the group (4) of cigarettes, so the lateral edges of the pull-up flap (21) are positioned substantially contacting lateral walls of the inner package (3).

3. A packet (1) of cigarettes as claimed in claim 1, wherein the stabilizing projection (31) is formed in the blank (29) by a U-shaped through cut (32), which defines the outer edge of the stabilizing projection (31) and originates from the fold line (30), which does not extend across the cut (32).

4. A packet (1) of cigarettes as claimed in claim 1, wherein the pull-up flap (21) is fitted to a front row of cigarettes (22) in the group (4) of cigarettes, and has a horizontal bottom wall (27) positioned contacting the bottom end (24) of the front row of cigarettes (22).

5. A packet (1) of cigarettes as claimed in claim 1, wherein the pull-up flap (21) is fitted to a front row of cigarettes (22) and an intermediate row of cigarettes (22) in the group (4) of cigarettes, and has a horizontal bottom wall (27) positioned contacting the bottom end (24) of the front row of cigarettes (22), and the bottom end (24) of the intermediate row of cigarettes (22).

6. A packet (1) of cigarettes as claimed in claim 1, wherein the cover portion (6) closing the extraction opening (5) presses the grip end (23) of the pull-up flap (21) onto a wall of the group (4) of cigarettes.

7. A packet (1) of cigarettes as claimed in claim 1, wherein the outer container (2) has an open top end (7), and a cup-shaped lid (8) hinged to the outer container (2) along a hinge (9) to rotate, with respect to the outer container (2), between an open position and a closed position opening and closing the open top end (7) respectively.

8. A packet (1) of cigarettes as claimed in claim 1, wherein the stabilizing projections (31) projects perpendicular to the front wall (25) of the pull-up flap (21), and pushes against the front wall of the inner package (3) to increase the force needed to slide the pull-up flap (21), and so prevent the pull-up flap (21) from sliding, with respect to the front row of cigarettes (22).

9. A packet (1) of cigarettes as claimed in claim 1, wherein the stabilizing projection (31) makes the force required to slide the pull-up flap (21) with respect to the front row of cigarettes (22) greater than the force required to raise the pull-up flap (21) together with the front row of cigarettes (22)

so that the pull-up flap (21) is always raised together with the front row of cigarettes (22) when the grip end (23) of the pull-up flap (21) is pulled up.

10. A packet (1) of cigarettes comprising:

a cup-shaped outer container (2);

a group (4) of cigarettes;

an inner package (3), which is inserted irremovably inside the outer container (2), encloses the group (4) of cigarettes, and has an extraction opening (5) closed at least initially by a cover portion (6); and a pull-up flap (21), which is inserted inside the inner package (3), directly contacting the cigarettes (22) in the group (4) of cigarettes, is fitted to at least two cigarettes (22) in the group (4) of cigarettes, and has a grip end (23) which projects at the extraction opening (5) of the inner package (3) and is pulled up to lift up the cigarettes (22) to which the pull-up flap is fitted;

wherein the pull-up flap (21) is defined by a rigid blank (29) having at least one fold line (30), and is completely detached from, and so slides freely with respect to, the inner package (3);

wherein the pull-up flap (21) is folded into a U about the bottom end (24) of the front row of cigarettes (22), and comprises two lateral walls (33) located on opposite sides of the front row of cigarettes (22), and each positioned contacting a respective cylindrical lateral wall (26) of the front row of cigarettes (22), and a bottom wall (27) perpendicular to the lateral walls (33) and positioned contacting the bottom end (24) of the front row of cigarettes (22); and wherein one lateral wall (33*a*) of the pull-up flap (21) terminates with the grip end (23), which projects from a top wall of the group (4) of cigarettes, and the other lateral wall (33*b*) has no grip end (23) and is the same height as the group (4) of cigarettes.

* * * * *